US005730254A

United States Patent [19]

Nguyen

[11] Patent Number: 5,730,254

[45] Date of Patent: Mar. 24, 1998

[54] ELEVATOR DOOR RESTRAINT DEVICE

[75] Inventor: Hai T. Nguyen, Deerfield Beach, Fla.

[73] Assignee: Vertisys, Inc., Boca Raton, Fla.

[21] Appl. No.: 505,756

[22] Filed: Jul. 21, 1995

[51] Int. Cl.[6] ..... B66B 13/06

[52] U.S. Cl. ..... 187/335; 187/331; 187/334; 187/325

[58] Field of Search ..... 187/335, 331, 187/334, 325

[56] References Cited

U.S. PATENT DOCUMENTS

| | | |
|---|---|---|
| 309,757 | 12/1884 | Berry . |
| 468,376 | 7/1892 | Cove . |
| 649,662 | 5/1900 | Fassett . |
| 1,035,174 | 8/1912 | Edes . |
| 1,047,977 | 11/1912 | Stewart . |
| 1,119,001 | 12/1914 | Beardslee . |
| 1,213,689 | 11/1917 | Shalders . |
| 1,265,989 | 3/1918 | Hall et al. . |
| 1,284,554 | 11/1918 | Armstrong . |
| 1,326,440 | 12/1919 | Chaudoir . |
| 1,621,391 | 9/1927 | Williams . |
| 1,959,042 | 5/1934 | Staley . |
| 1,961,938 | 3/1934 | Norton . |
| 2,003,399 | 5/1935 | Tamsitt . |
| 2,566,411 | 9/1951 | Guilbert, Jr. . |
| 3,033,317 | 5/1962 | Beck et al. . |
| 3,056,470 | 10/1962 | Moser et al. . |
| 3,212,607 | 10/1965 | Smith . |
| 3,605,952 | 9/1971 | Lusti . |
| 3,625,312 | 12/1971 | Hutner . |
| 3,738,454 | 6/1973 | Atkey . |
| 3,912,049 | 10/1975 | Holland et al. . |
| 3,921,763 | 11/1975 | Westerlund . |
| 3,991,858 | 11/1976 | Westerlund . |
| 4,313,525 | 2/1982 | McDonald . |
| 4,364,454 | 12/1982 | Glaser et al. . |
| 4,410,067 | 10/1983 | Leiner et al. . |
| 4,423,799 | 1/1984 | Glaser et al. . |
| 4,454,931 | 6/1984 | Leiner et al. . |
| 4,483,420 | 11/1984 | Byrne . |
| 4,491,200 | 1/1985 | Thompson et al. . |
| 4,512,443 | 4/1985 | Dewhurst . |
| 4,926,974 | 5/1990 | Morris et al. . |

(List continued on next page.)

FOREIGN PATENT DOCUMENTS

| | | | |
|---|---|---|---|
| 265521 | 5/1964 | Australia | 187/335 |

*Primary Examiner*—William E. Terrell
*Assistant Examiner*—Khoi H. Tran
*Attorney, Agent, or Firm*—Brooks & Kushman PC

[57] ABSTRACT

An elevator car door restraint includes a position indicator mounted at the access points at each of the floors, a locking arm pivotally mounted between its ends on a first portion of the car for movement of the first end of the locking arm between an engaged and disengaged position, and for contact by the second end of the locking arm with one of the position indicators. A lock plate mounted on the second portion of the car which moves relative to the first portion of the car when the car door moves includes a contact face which is engageable with the first end of the locking arm when the first end is moved to the engaged position to mechanically restrain the elevator car door from opening. The locking arm is biased by a spring so that the first end of the arm is rotated into engagement position unless the first end is permitted from such rotation by contact of the second end with a position indicator. An integral hoistway interlock for center-parting the hoistway access doors is also provided. The hoistway interlock includes a rotating keeper mounted on one of the hoistway doors and a stationary keeper which is mounted on the other hoistway door. When the hoistway access doors are closed, the rotating keeper rotates into engagement with the stationary keeper, thereby locking the access doors. A kickpad mounted on one end of the rotating keeper includes a cam surface which rotates the rotating keeper out of engagement with the stationary keeper when the kickpad itself is rotated within the passageway between the engagement blades as the engagement blades move into coupling engagement with the kickpad during normal opening of the elevator doors.

5 Claims, 8 Drawing Sheets

U.S. PATENT DOCUMENTS 4,926,975 5/1990 Morris .
4,934,488 6/1990 Umemura .
4,947,964 8/1990 Husmann .
4,991,347 2/1991 Takimoto et al. .
5,129,486 7/1992 Steacy et al. .
5,139,112 8/1992 Tonna et al. .
5,377,785 1/1995 Pearson ..... 187/335

Fig. 6
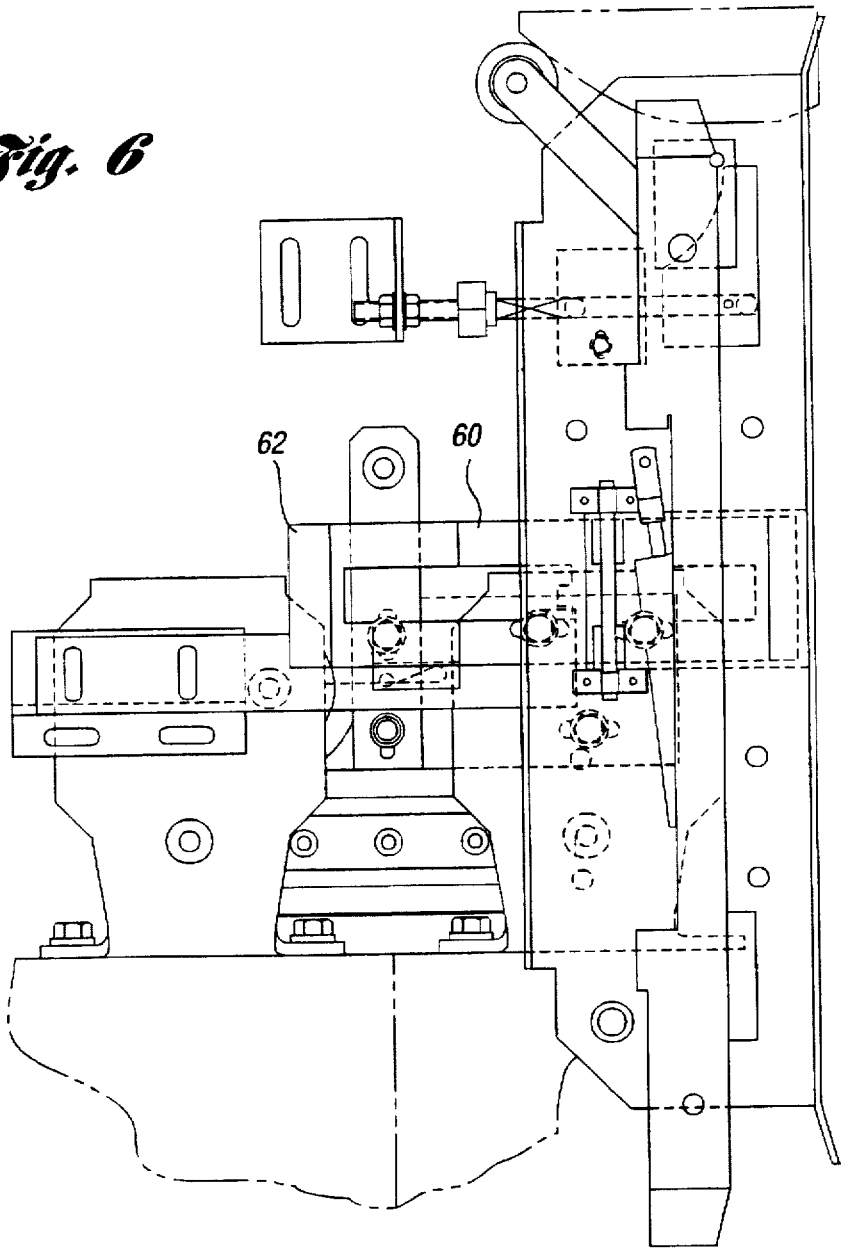
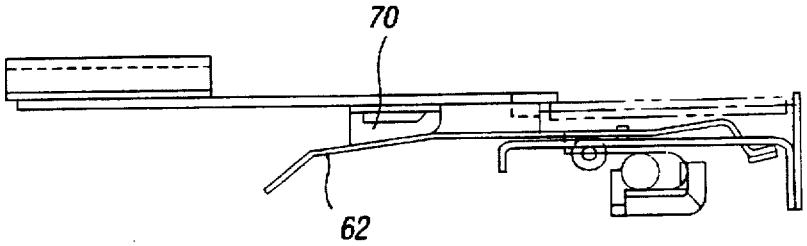
Fig. 7

ELEVATOR DOOR RESTRAINT DEVICE

TECHNICAL FIELD

This invention relates to elevator car door and hoistway door restraints which may be employed with existing elevator door operators to mechanically restrain the doors from opening when the elevator car is not in a passenger exit position in a hoistway.

BACKGROUND ART

Passenger transport systems, and elevators in particular, typically employ door coupling mechanisms which mechanically couple the car doors to access doors located at desired passenger stops so that both the car door and access door can be simultaneously and jointly controlled to open or close to allow for entry and exit of passengers.

It is also known to employ mechanical elevator car door and/or hoistway door interlocks which prevent one or both of the doors from opening in the event the elevator car stops at a location other than one of the desired stopping points, such as, for example, where a power or control failure occurs.

Various mechanical car door locking systems have been developed which are integrated with the car door coupling mechanism. One example, shown in U.S. Pat. No. 1,326,440, entitled "Apparatus for Operating and Interlocking the Landing and Cage Gates of Elevators," issued to Shaudoir, shows an elevator/hoistway door coupling mechanism employing a mechanical interlock which prevents the elevator door and/or hoistway door from opening unless the elevator car is in the desired position at a hoistway landing. Another example, U.S. Pat. No. 4,313,525, entitled "Car Door Safety Interlock," issued to McDonald, discloses a power operated sliding door of an elevator car which is provided with a mechanical safety interlock which restrains the elevator car door from opening unless disengaged through mechanical interconnection responsive to motion of a door coupling vane contacting a pair of door hatch rollers. U.S. Pat. No. 4,423,799, entitled "Vehicle Door Lock for Limiting Door Opening to Specified Vehicle Positions," issued to Glaser, et al., similarly discloses a locking mechanism which restrains elevator car doors from opening unless disengaged as an indirect result of the engagement of the elevator car door/hoistway door coupling mechanism.

These and other existing mechanical interlock systems, however, typically utilize several interconnected moving parts and are difficult or impossible to retrofit on existing elevator systems.

One object of the present invention is, therefore, to provide a mechanical car door restraint which employs few moving parts.

Another object of the present invention is to provide a mechanical car door restraint which is integrated with a conventional parallel blade-type door coupling mechanism so that the hoistway door coupling element serves the additional functions of position sensor and operator for the mechanical restraint.

It is yet another object of the present invention to provide a mechanical car door restraint which is simple in design and operation, to facilitate easy installation, service, and retrofitting of the device onto existing elevator systems.

It is yet another object of the present invention to provide a hoistway door interlock for center-parting hoistway doors which is simple in design and operation, and which positively interlocks the center-parting doors to prevent both doors from opening even when the relating cable is broken.

DISCLOSURE OF THE INVENTION

In carrying out the above and other objects, the mechanical car door restraint of the present invention includes a position indicator mounted at each of the floors, a locking arm pivotally mounted between its ends on a first portion of the car for movement of the first end between an engaged and disengaged position, and for contact by the second end with one of the position indicators, a lock plate mounted on the second portion of the car which moves relative to the first portion of the car when the car door moves, including a contact face which is engageable with the first end of the locking arm when the first end is moved to the engaged position to mechanically restrain the car door from opening, and a spring mounted on the locking arm to bias the first end of the arm into engagement position unless the first end is permitted from rotation into the engagement position by the contact of the second end with a position indicator.

The present invention is preferably integrated with an elevator door/hoistway door coupling mechanism including a pair of elongate, generally parallel engagement blades mounted on the car in spaced, opposed position and defining a passageway extending in the direction of the travel of the car, and a coupling member mounted on each of the hoistway doors. The coupling member is positioned to enter the passageway between the engagement blades when the elevator car is aligned with the hoistway door for coupling of the car door and the hoistway door. The coupling member simultaneously acts as a position indicator and operator by contacting the second end of the locking arm and providing a cam surface which rotates the locking arm about its pivotal axis to move the first end to a disengagement position, thereby disabling the restraint, when the elevator car is in a desired stopping position opposite a hoistway door.

The present invention also preferably includes an integrated hoistway door interlock including a rotating keeper mounted on a portion of the hoistway door assembly which is coupled with the elevator car doors as the doors are opened, and a stationary keeper which is mounted on a second portion of the hoistway assembly which moves relative to the rotating keeper when the coupled hoistway door and rotating keeper are pulled open. Each of the rotating keeper and stationary keeper also preferably include electrical contacts which, when the keepers are engaged (when the hoistway access doors are closed), complete an electrical circuit which is monitored by the elevator car control. If the hoistway interlock on any hoistway access door is disengaged, the circuit is broken (indicating either that the elevator car doors and coupled hoistway access doors are open, or that a fault condition has occurred), signaling to the elevator car control to disable the elevator car from movement within the hoistway.

In one embodiment employing center-parting doors, the rotating keeper is mounted for movement with one of the hoistway access doors. The rotating keeper is pivotally mounted between its ends for movement of the first end between engagement and disengagement with the stationary keeper. In this embodiment, the coupling member is mounted on the second end of the rotating keeper and serves as a kickpad. The kickpad includes a cam surface which rotates the rotating keeper out of engagement with the stationary keeper as the kickpad is rotated within the passageway between the engagement blades as the engagement blades move into coupling engagement with the kickpad during normal opening of the elevator doors. The stationary keeper is mounted for movement on the other of the hoistway access doors such that when the center-parting doors are closed, the rotating keeper and stationary keeper move into the engaged position. An interlock housing is also preferably mounted in a stationary position (such as, for example, on the hoistway access door header) and includes the electrical contacts and wiring necessary to form a completed circuit when both the rotating keeper and the stationary keeper slide into engaged position within the housing. In this configuration, the interlock serves as a mechanical lock for the hoistway access doors as well as an electrical control circuit which, if broken, disables the elevator car control system from moving within the hoistway.

It will be appreciated that although the present invention is described as a mechanical restraint for elevator car doors, it has other uses, such as in other passenger transport systems including passenger cars which travel to a plurality of selected stopping points, which similarly require an automatic mechanical car door restraint in the event a power outage or control failure causes the passenger car to stop in a position other than one of the desired stopping points.

It will also be appreciated that though the hoistway interlock of the present invention is integrated with the elevator door coupling mechanism, it may be alternatively adapted for installation and use independently of the elevator door coupling mechanism and/or elevator car door restraint.

These and other objects, features and advantages of the present invention are readily apparent from the following detailed description of the best mode for carrying out the invention when taken in connection with the accompanying drawings.

BRIEF DESCRIPTION OF THE DRAWING

FIG. 6 is a partial front elevation of the coupling mechanism and mechanical restraint mounted on an elevator door;

FIG. 7 is a partial top view of the mechanical restraint with the elevator doors closed;

BEST MODE FOR CARRYING OUT THE INVENTION

Figure 1:
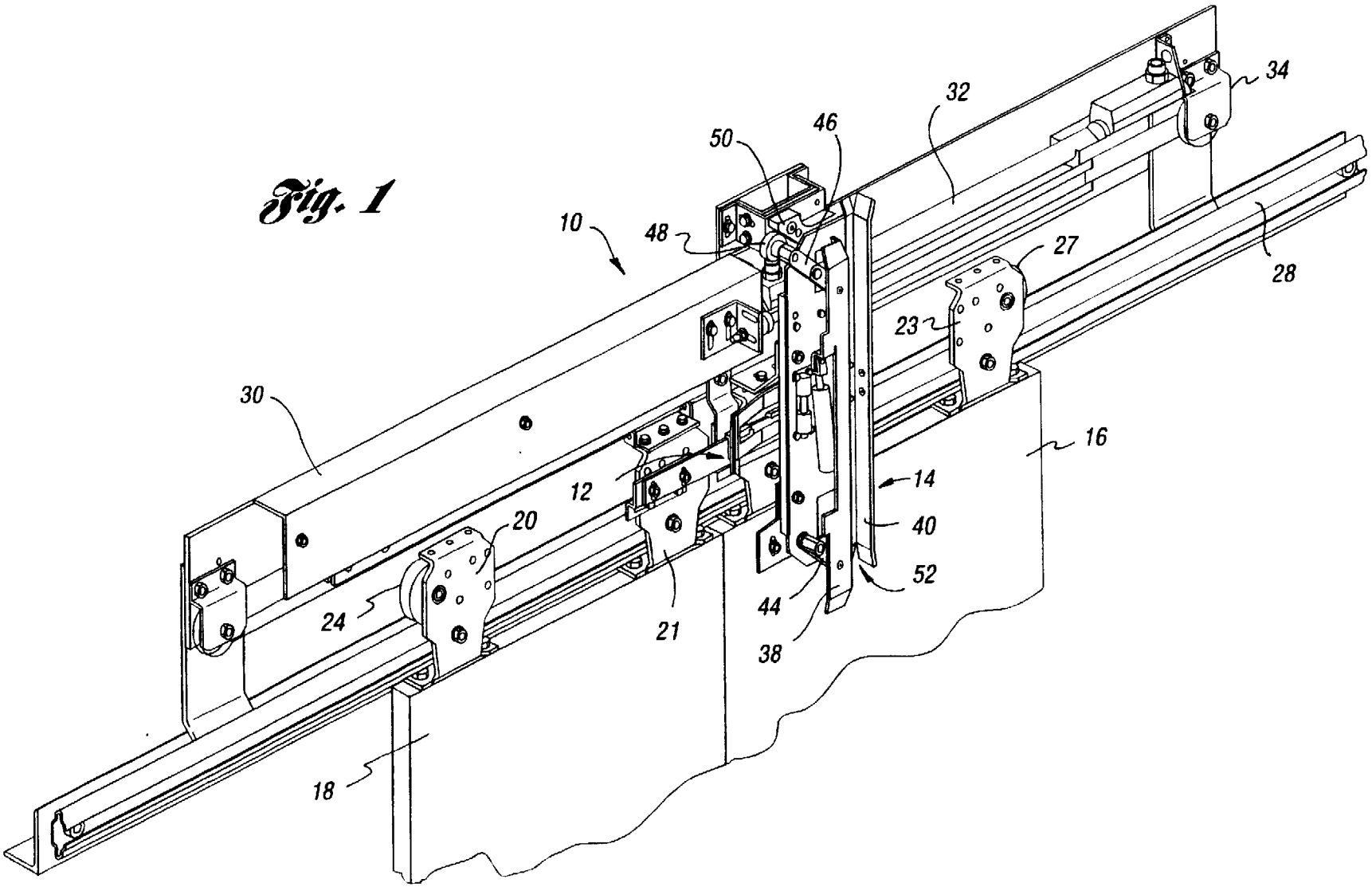
FIG. 1 is a perspective view of an elevator car door operator including the coupling device with the mechanical restraint of the present invention.
Figure 2:
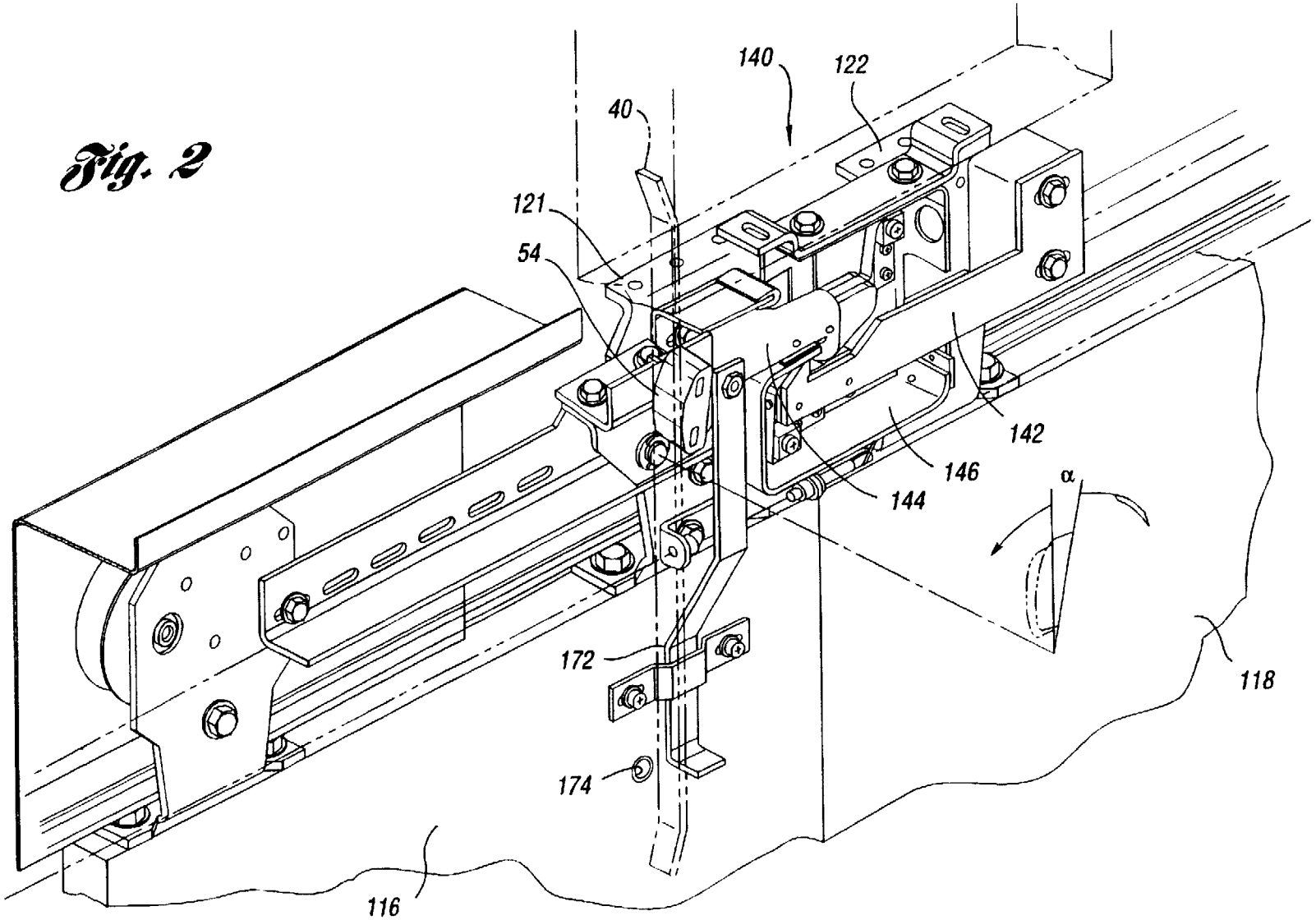
FIG. 2 is a fragmentary, schematic elevation view, from the car side, of a hoistway door and coupling member used in connection with the elevator car illustrated in FIG. 1.

FIGS. 1 and 2 illustrate an elevator installation 10 including the car door restraint 12 (shown in isolation in FIG. 3) mounted for integral operation in a conventional parallel blade-type door coupler 14. With the exception of the car door restraint 12, the elevator installation 10 may be a conventional, commercially available system. In the embodiment shown, the elevator 10 includes a pair of center opening car doors 16 and 18 suspended in a conventional manner by hangers 20–23. Grooved wheels 24–27 are mounted, respectively, on hangers 20–23 and are suspended on a guide rail 28 which is mounted on a header 30 on the elevator car. At least one of the hangers (22) is operably connected to an actuator 32 for powered opening and closing of the elevator car doors 16, 18. In the embodiment shown, the actuator 32 comprises a conventional hydraulic door operator of the type disclosed in U.S. Pat. No. 4,910,961, which is commercially available from Vertisys, Inc., the assignee of the present invention. The drive power is, of course, transmitted via a conventional pulley and cable drive assembly to simultaneously open and close both of the center opening doors 16 and 18 of the elevator 10. It will be appreciated that the elevator installation described above is of a conventional type and is shown for illustrative purposes only. As will be described in further detail below, the mechanical car door restraint may be employed with most conventional elevators to provide a simple, effective mechanical lock for the elevator car doors when the car stops out of position.

FIG. 2 illustrates a hoistway access door assembly which may be utilized in the elevator installation 10. In this embodiment, two center-opening hoistway doors 116 and 118 are suspended in a conventional manner on a header over an access opening in the hoistway. The hoistway doors 116 and 118 are driven by coupling engagement with the elevator car doors 16 and 18 as described herein. In the illustrated embodiment, the coupling member 54 is mounted on bracket 121 so that hoistway door 116 is opened as a result of coupling engagement with the door coupler 14 on the elevator car doors. The drive power is transmitted via a conventional pulley and cable drive assembly to simultaneously open and close the other access door 118. The illustrated embodiment also includes a hoistway door interlock 140 including a stationary keeper 142 mounted on bracket 122 for movement along with hoistway door 118, and a rotating keeper 144 mounted on bracket 121 for movement with hoistway door 116. An interlock housing 146 is mounted on the door header to receive each of the keepers 142, 144 as they move into engagement with each other. In one embodiment, the engaged keepers 142 and 144 each include electrical contacts which contact each other during engagement, as well as contacting electrical contacts mounted in the housing 146 to form a completed circuit which may be monitored by the elevator car control. The operation of the hoistway interlock will be described hereinafter in further detail. However, it should be noted that in the illustrated embodiment, the coupling member 54 also serves as a kickpad which serves as an operator to disengage the rotating keeper 144 from the horizontal keeper 142, and thus disengage the interlocked hoistway doors, when the elevator car door is in the appropriate position and coupled for opening or closing of the elevator and hoistway car doors.

Referring again to FIG. 1, a door coupling mechanism 36 includes a pair of elongate, generally parallel engagement blades 38, 40 mounted on a base plate 42, which in turn is fixedly mounted on one of the elevator doors 16. One of the engagement blades 40 is typically formed as an integral part of the base plate 42. The other engagement blade 38 is mounted on the ends of pivot arms 44 and 46 which are each rotatably mounted on the base plate 42. A wheel 48 is rotatably mounted on one end of the upper pivot arm 46 and acts as a cam follower which contacts cam 50, mounted on the elevator car door header 30, to rotate the upper pivot arm 46 as the elevator car door 16 is opened. The rotation of the upper pivot arm 46, as well as the follower pivot arm 44, moves engagement blade 38 towards engagement blade 40 while maintaining engagement blades 38 and 40 in a generally parallel orientation. Thus, as elevator car door 16 is opening, the passageway 52 between the engagement blades 38 and 40 is constricted so that, if the elevator car is properly aligned in the hoistway with the hoistway door coupling member 54 (FIG. 2) located in the passageway 52, the engagement blades 38 and 40 smoothly and securely grip the coupling member thereby opening the hoistway door(s) simultaneously with the elevator car doors 16 and 18.

Figure 3:
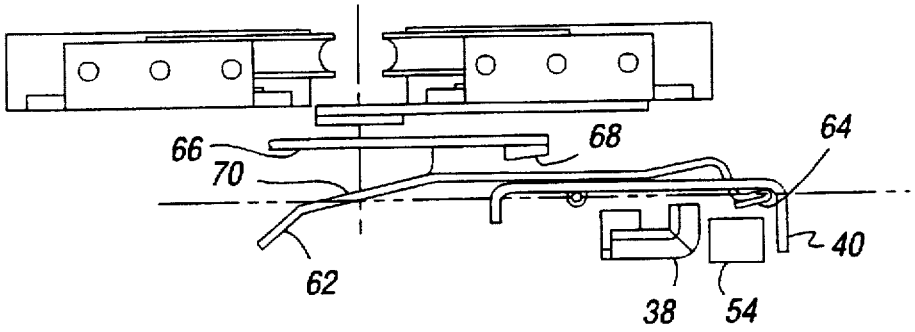
FIG. 3 is a top view of the mechanical restraint with the elevator doors closed and the hoistway coupling member in position.
Figure 4:
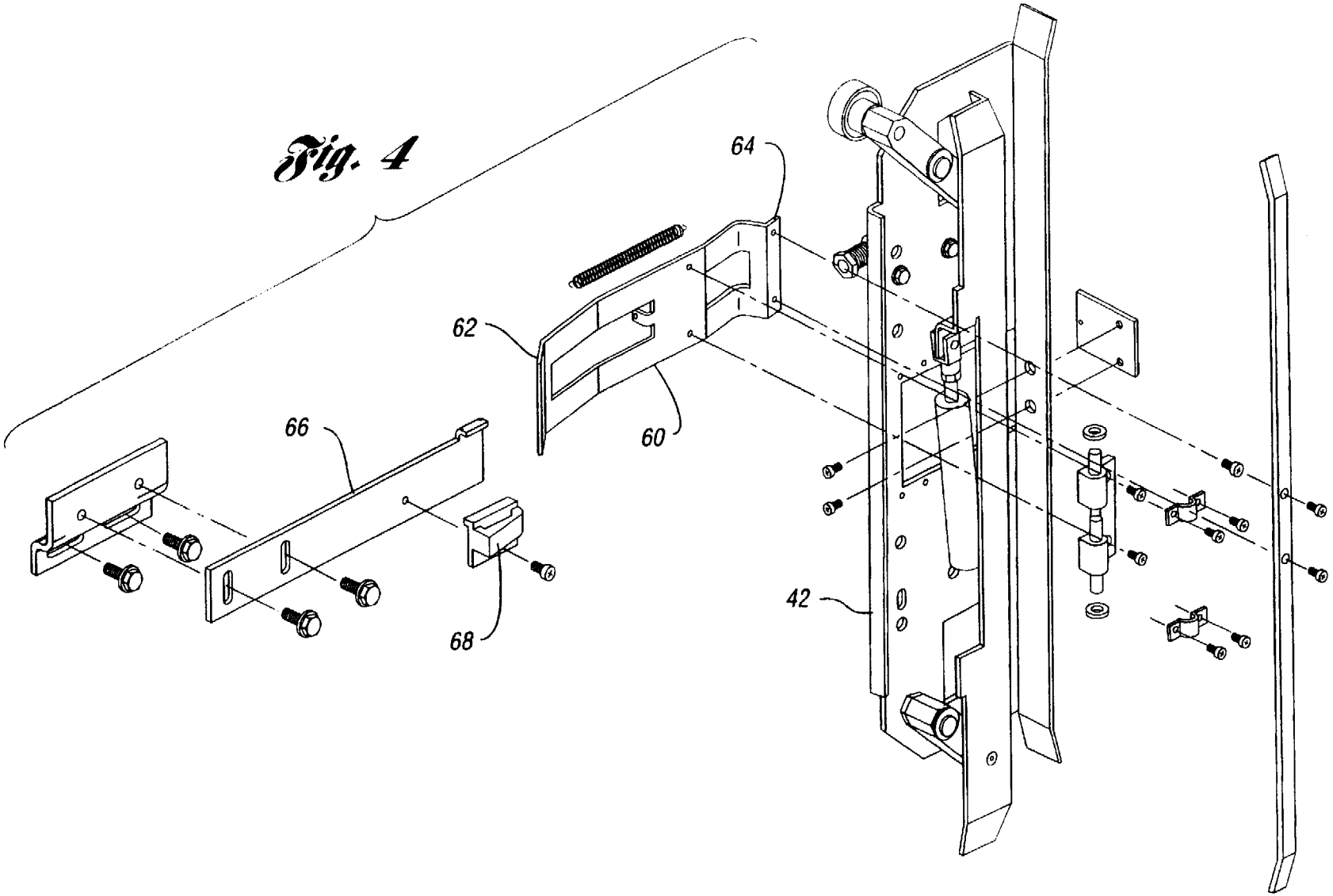
FIG. 4 is a partial front elevation of the coupling mechanism and mechanical restraint mounted on an elevator door in the form of an exploded geometric description.

Referring to FIGS. 3 and 4, in this embodiment the car door restraint 12 includes a locking arm 60 pivotally mounted between its ends for movement of the first end 62 between an engaged and disengaged position, and for contact and movement of the second end 64 of the locking arm 60 with a coupling member 54 when the coupling member 54 is located within the passageway 52 of the door coupler 14. The car door restraint 12 also includes a lock plate 66 which is fixedly mounted on a portion of the elevator which moves relative to the locking arm as the elevator doors are opened. In the illustrated embodiment, for example, the lock plate 66 is mounted upon bracket 21 of car door 18, and the locking arm is mounted on the base plate 42.

The lock plate 66 includes a contact face having an engagement blade 68 which is engageable with the first end 62 of the locking arm 60 in the event the locking arm is rotated into engagement position due to (1) the absence of a hoistway door coupling member 54 in the passageway 52, and (2) opening of the car doors to more than a selected maximum distance. The lock plate 66 may also include a guide surface 70 upon which the first end 62 of the locking arm 60 rests and slides as the elevator car doors 16, 18 open to facilitate smooth, controlled rotation of the locking arm into locking engagement with the lock plate as the elevator doors begin to open.

Figure 5:
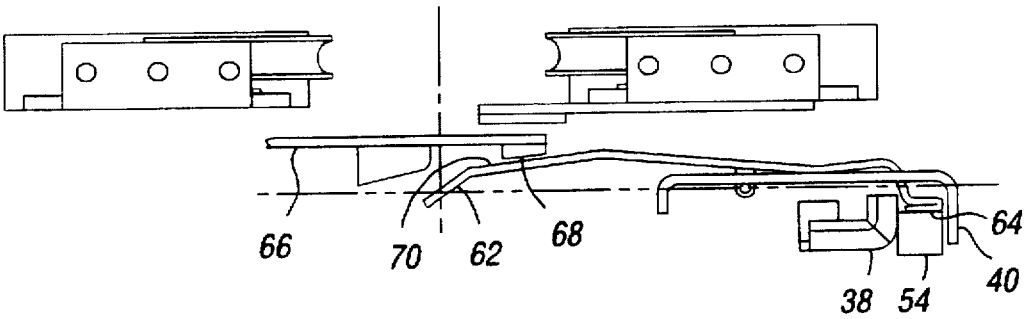
FIG. 5 is a top view of the mechanical restraint with the elevator doors displaced about one and one-half inches and the locking arm rotated out of engagement position by contact with the hoistway door coupling member.

As shown in FIG. 3, with the elevator car doors 16, 18 fully closed when the elevator car is stopped in a proper access position opposite hoistway doors, the locking arm 60 is retained by contact with the hoistway door coupling member 54 on the second end of the locking arm 60 in a position in which the first end 62 of the locking arm is clear, and will not engage, the flange on the locking plate 68 as the doors are opened, as shown in FIG. 5.

FIGS. 6 and 7 illustrate the orientation of the various components of the car door restraint 12 when the elevator doors are fully closed and the elevator car is stopped in an undesired position. When the doors are closed, the locking arm 60 is supported from rotation into engagement position by contact of the first end 62 of the locking arm 60 with the guide surface 70 on the lock plate. As the doors are opened, however, the locking arm slides along the inclined cam surface of the guide surface 70 toward engagement.

Figure 8:
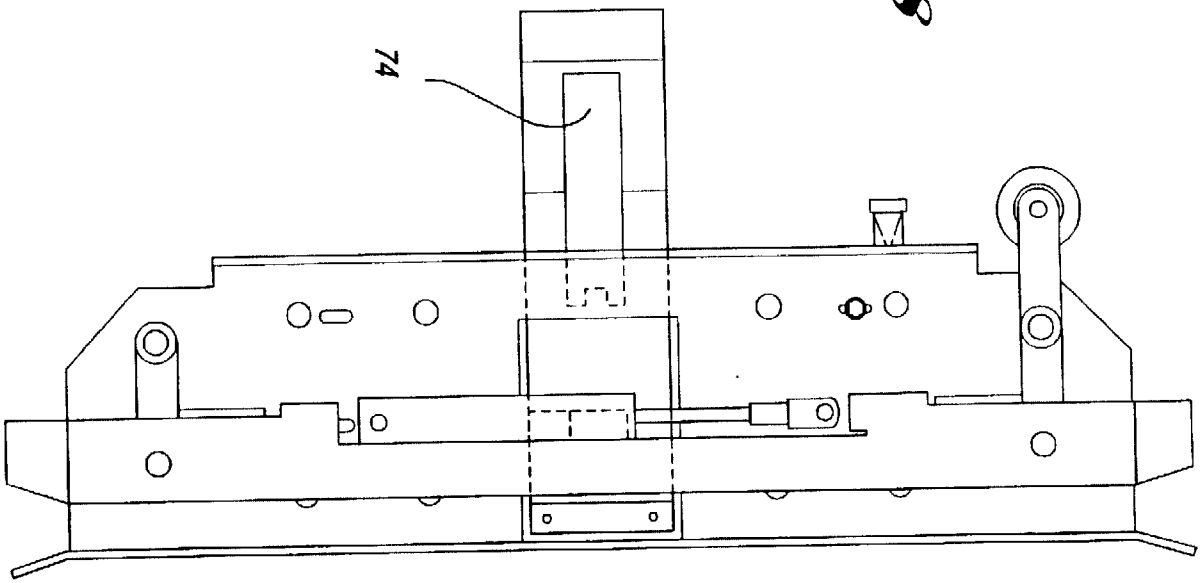
FIG. 8 is a partial front elevation of the coupling mechanism and mechanical restraint mounted on an elevator door showing the engagement blades in the engaged position.
Figure 9:
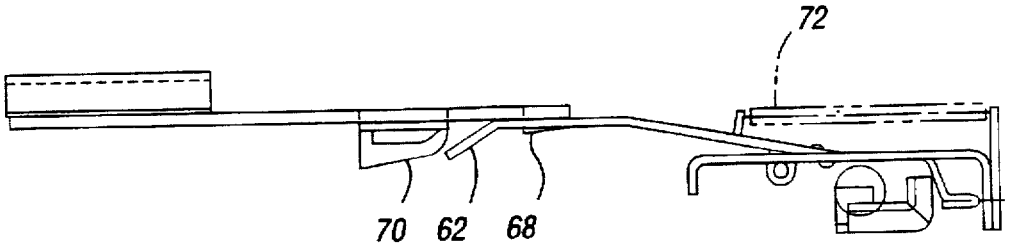
FIG. 9 is a partial top view of the mechanical restraint with the elevator doors displaced one and one-half inches and the mechanical restraint engaged.

As shown in FIGS. 8 and 9, when the doors are displaced a predetermined distance, preferably about one and one-half inches, the first end 62 of the locking arm is clear from the guide surface 70 and is urged by the unrestrained force of the spring 72 into engagement with the flange 68 now protruding into slot 74 on the locking arm 60. At this point the elevator car doors are mechanically restrained or locked from further opening.

The restraint is, of course, unlocked by the contact of the locking arm 60 with the guide surface 70 on the lock plate as the doors are moved to a closed position. Alternatively, the restraint may be manually disengaged by a knowledgeable service person who gains access to the coupling mechanism in the hoistway during an emergency.

Figure 10:
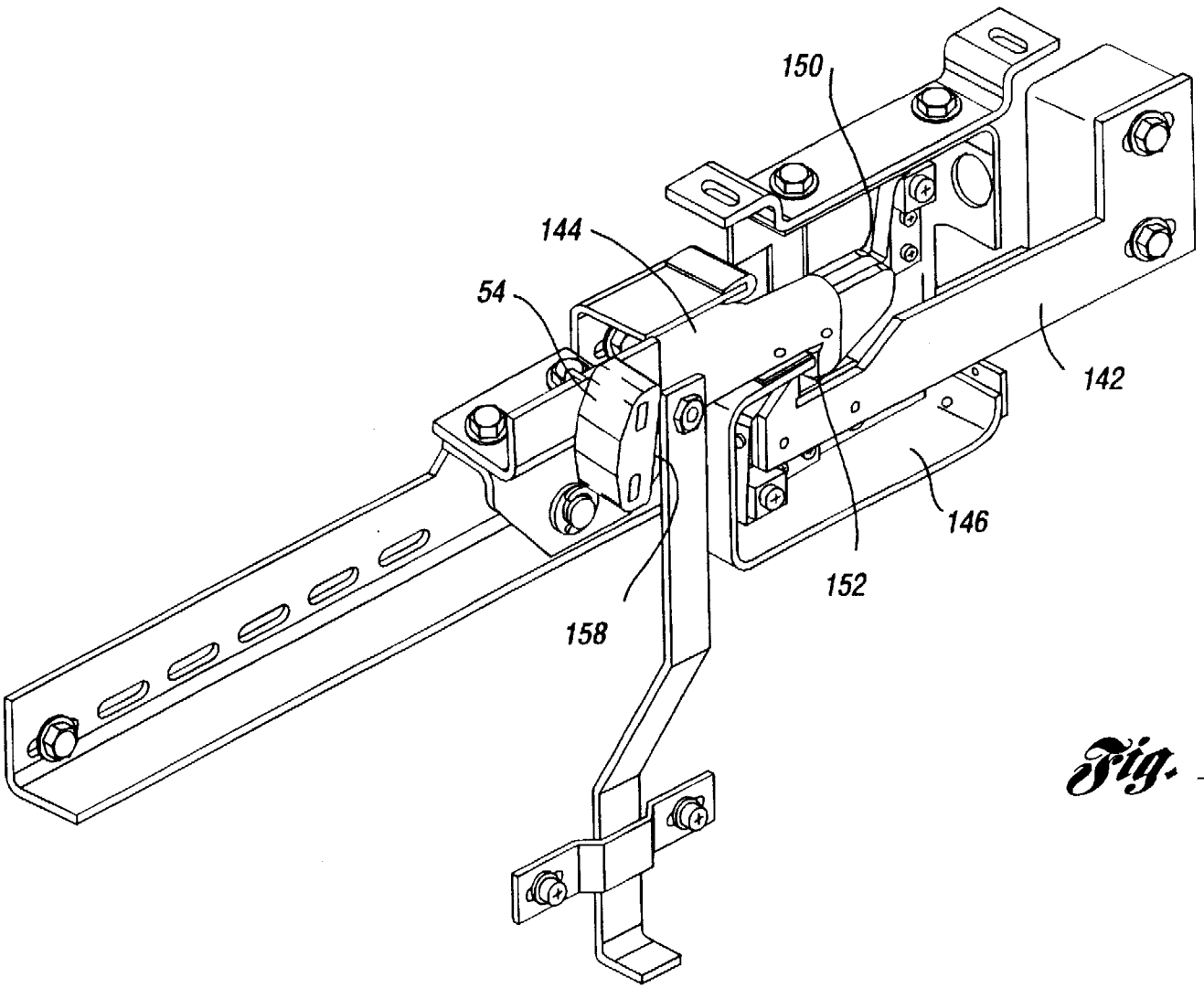
FIG. 10 is an isolated perspective view including the coupling member/kickpad and hoistway door interlock which may be integrated with the elevator car door restraint device illustrated in FIG. 1 for use with center-parting hoistway doors.
Figure 11:
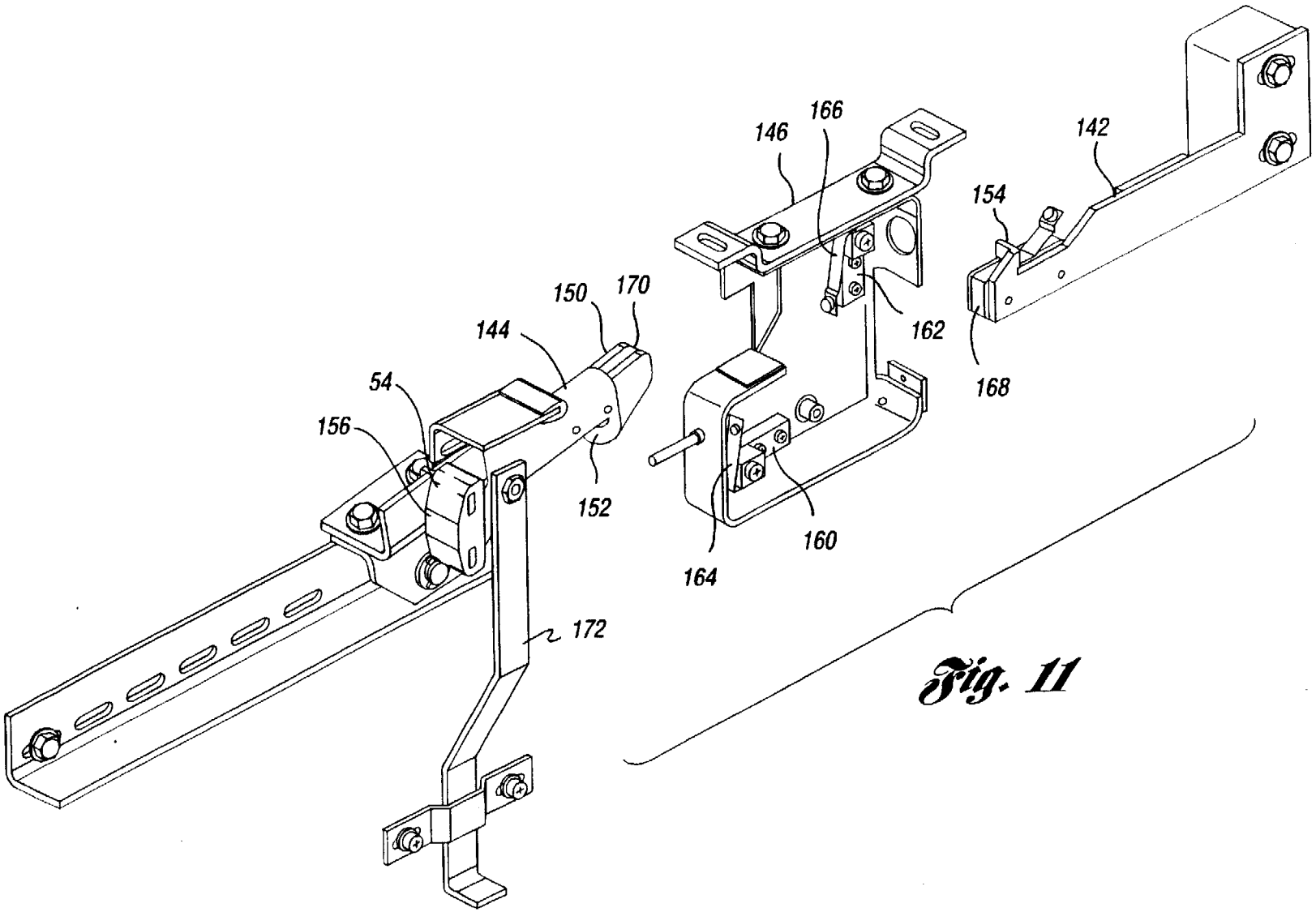
FIG. 11 is a partial perspective view of a hoistway interlock of FIG. 10, with the interlock disengaged and the doors opened.

FIGS. 10 and 11 illustrate the components of the hoistway interlock which may be employed with center-parting hoistway doors in one embodiment of the present invention. In FIG. 10, the stationary keeper 142 and rotating keeper 144 are shown in the engaged position (i.e., the hoistway access doors are closed) within the interlock housing 146. The first end 150 of the rotating keeper includes a protruding locking surface 152 which locks in mating engagement with locking flange 154 on the stationary keeper 142. A kick plate is mounted on the second end 156 of the rotating keeper, such that, when the rotating keeper 144 is in the locked position; the major vertical surface 158 of the kickpad is tilted at an angle $\alpha$ (preferably about 10°) from vertical (shown in FIG. 2). Engagement of the kickpad between the engagement blades of the car door coupling mechanism urges the surface 158 of the kickpad into a vertical position, thereby rotating the rotating keeper 144 out of engagement with the stationary keeper 142.

In the embodiment shown in FIGS. 2, 10 and 11, the interlock housing 146 includes terminal blocks 160 and 162 which are suitably connected in a conventional circuit to the elevator car control. Shunts 164 and 166 are mounted on terminal blocks 160 and 162, respectively. Shunt 164 is positioned to contact shunt 168 on the end of the stationary keeper 142 when the hoistway access doors are closed and the stationary keeper is moved into engagement position within the interlock housing 146. Similarly, shunt 166 is positioned to contact shunt 170, located on the first end of the rotating keeper 144 when the hoistway access doors are closed and the rotating keeper is moved into engagement position within the interlock housing 146. Shunts 168 and 170 are also positioned to contact each other when rotating keeper 144 is engaged with stationary keeper 142, thereby completing the electrical circuit whenever the hoistway access doors are closed and the interlock is engaged. Conversely, disengagement of the rotating keeper 144 from the stationary keeper 142 mechanically unlocks the hoistway access doors 116 and 118 as well as breaking the control circuit within the interlock housing 146. Since the unlocked hoistway doors indicate either that the hoistway doors are coupled to the elevator car doors for opening, or that a fault condition exists, the incomplete circuit indicates to the elevator car control that the car should not be moved within the hoistway. The interlock may also be provided with an emergency unlocking arm 172 which is mounted on the rotating keeper 144 to allow for manual displacement of the unlocking arm 172 to disengage the rotating keeper 144 and unlock the horizontal access doors in an emergency. An emergency access hole 174 (FIG. 2) may also be provided in the hoistway access door 116 to accommodate a key or other suitable tool for moving the manual unlocking arm 172 when required.

Thus, the mechanical car door restraint 12 and hoistway interlock 140 of the present invention employ few components which may integrated into existing elevator systems to provide a simple, yet effective mechanical restraint for elevator car and hoistway doors. It will be appreciated that, though the mechanical restraint is shown in the embodiments of FIGS. 1–9 installed for operation in an elevator car having two center parting doors, the restraint is equally useful with other slidable elevator car door arrangements. Though the mechanical restraint 12 is installed for integrated operation with an elevator door/hoistway door coupling mechanism of the type included herein, the mechanical car door restraint 12 may also be suitably installed to operate independently of the door coupling mechanism in other systems. In those systems, a position indicator having a cam surface which acts as an operator on the second end 64 of the locking arm 60 is mounted at a suitable position at each of the appropriate stopping locations in the hoistway.

While the best mode for carrying out the invention has been described in detail, those familiar with the art to which this invention relates will recognize various alternative designs and embodiments for practicing the invention as disclosed by the following claims.

What is claimed is:

1. In an elevator system including an elevator car having at least one door, which car travels in a hoistway to a plurality of floors, and wherein the hoistway includes at least one access door at each floor, a car door operator comprising, a coupler including, a pair of elongate, generally parallel engagement blades mounted on the car in a spaced, opposed position defining a passageway extending in the direction of travel of the car;

a coupling member mounted at each of the floors to enter the passageway between the engagement blades when the car aligned with the access door for operative engagement with the engagement blades and coupling of the car door with the access door for movement of the car and access doors in unison; and a mechanical restraint including, a locking arm including a first end having a locking surface and a second end having a contact surface, the arm being pivotally mounted on a first portion of the car, the arm being mounted between the first end and the second end for movement of the first end between an engaged and disengaged position, and for contact by the second end with a coupling member when the access door is in coupling alignment with the car door, a lock plate mounted on a second portion of the car which moves relative to the first portion of the car when the car door moves, the lock plate including a contacting face which is engageable with the locking surface on the first end of the arm when the first end is moved to the engaged position to prevent further opening of the car door, and a spring mounted on the arm to bias the first end of the arm into engagement position unless the first end is prevented from rotation into the engagement position by the contact of the second end with a coupling member.

2. The elevator system of claim 1 further including a hoistway access door interlock having a stationary keeper that is fixedly mounted on a first portion of the hoistway access door assembly, and a rotating keeper including a first end having a locking surface and a second end having a contact surface, the rotating keeper being rotatably mounted on a second portion of the hoistway access door assembly which moves relative to the first portion of the hoistway door assembly when the hoistway doors are moved, the rotating keeper being mounted between the first end and the second end for movement of the first end between an engaged and a disengaged position, and for contact by the second end with a position indicator on the elevator car.

3. The elevator system of claim 2 wherein the coupling member is mounted on the second end of the rotating keeper and includes a cam surface which, upon engagement with the parallel engagement blades of the coupler, rotates the rotating keeper into a disengaged position to thereby unlock the hoistway access doors and couple the doors to be with the elevator car doors.

4. The elevator system of claim 2 wherein a kickpad is mounted on the second end of the rotating keeper and includes a cam surface which, upon engagement with the position indicator on the elevator car, rotates the rotating keeper into a disengaged position to thereby unlock the hoistway access doors.

5. The elevator system of claim 2 further including an electric circuit connected to the elevator car control, and wherein the stationary keeper and rotating keeper each includes conductive contacts which are positioned to be in contact when the stationary keeper and rotating keeper are engaged, thereby completing the electric circuit.

* * * * *